US009156057B2

(12) United States Patent
Larson et al.

(10) Patent No.: US 9,156,057 B2
(45) Date of Patent: Oct. 13, 2015

(54) METHOD FOR CONTROLLING THE VISCOSITY OF A SPRAYABLE MIXTURE

(75) Inventors: John Charles Larson, West Chester, PA (US); Robert John Barsotti, Franklinville, NJ (US); Laura Ann Lewin, Greenville, DE (US)

(73) Assignee: AXALT COATING SYSTEMS IP CO., LLC, Wilmington, DE (US)

( * ) Notice: Subject to any disclaimer, the term of this patent is extended or adjusted under 35 U.S.C. 154(b) by 0 days.

(21) Appl. No.: 13/141,369

(22) PCT Filed: Dec. 23, 2009

(86) PCT No.: PCT/US2009/069359

§ 371 (c)(1),
(2), (4) Date: Jul. 22, 2011

(87) PCT Pub. No.: WO2010/075486

PCT Pub. Date: Jul. 1, 2010

(65) Prior Publication Data

US 2011/0274931 A1 Nov. 10, 2011

(51) Int. Cl.

| | |
|---|---|
| ***B05D 1/02*** | (2006.01) |
| ***B05B 7/24*** | (2006.01) |
| ***B05B 7/30*** | (2006.01) |
| ***B05D 1/34*** | (2006.01) |
| *B05B 7/08* | (2006.01) |
| *B05B 7/12* | (2006.01) |

(52) U.S. Cl.

CPC ..... *B05D 1/02* (2013.01); *B05B 7/0869* (2013.01); *B05B 7/2405* (2013.01); *B05B 7/30* (2013.01); *B05D 1/34* (2013.01); *B05B 7/0815* (2013.01); *B05B 7/129* (2013.01); *B05B 7/2478* (2013.01); *Y10T 428/31504* (2015.04)

(58) Field of Classification Search

None

See application file for complete search history.

(56) References Cited

U.S. PATENT DOCUMENTS

| | | | | |
|---|---|---|---|---|
| 2,757,048 | A | 7/1956 | Balmer | |
| 4,256,621 | A | 3/1981 | Shimokai et al. | |
| 4,824,017 | A | 4/1989 | Mansfield | |
| 5,052,623 | A | 10/1991 | Nordeen | |
| 5,772,116 | A | 6/1998 | Holt | |
| 5,954,273 | A | 9/1999 | Ruta et al. | |
| 6,130,286 | A * | 10/2000 | Thomas et al. | 524/507 |
| 6,297,311 | B1 * | 10/2001 | Casper et al. | 524/507 |
| 6,894,123 | B2 * | 5/2005 | Pelosi et al. | 525/379 |

(Continued)

FOREIGN PATENT DOCUMENTS

| | | | |
|---|---|---|---|
| DE | 1009071 B | * | 5/1957 |
| DE | 3116652 A1 | | 11/1982 |

(Continued)

OTHER PUBLICATIONS

English translation (machine) of DE 1009071B.*

(Continued)

*Primary Examiner* — Timothy Meeks
*Assistant Examiner* — Michael P Rodriguez
(74) *Attorney, Agent, or Firm* — Ingrassia Fisher & Lorenz, P.C.

(57) ABSTRACT

The present invention is directed to a method for controlling the viscosity of a sprayable mixture. The sprayable mixture forms a layer of a coating composition on an applied substrate and forms crosslinked network after drying and curing the layer. The dried and cured composition provides the substrate with a coating having a good appearance.

16 Claims, 10 Drawing Sheets

(56) References Cited

U.S. PATENT DOCUMENTS

| | | | | |
|---|---|---|---|---|
| 7,201,289 | B2 | 4/2007 | Bhatia | |
| 7,311,265 | B2 | 12/2007 | Bhatia | |
| 2003/0157263 | A1* | 8/2003 | Walters et al. | 427/421 |
| 2004/0249114 | A1 | 12/2004 | Swift et al. | |
| 2005/0059792 | A1* | 3/2005 | Roesler et al. | 528/44 |
| 2006/0022067 | A1 | 2/2006 | Bhatia | |
| 2007/0116960 | A1* | 5/2007 | Nickel | 428/413 |
| 2007/0270543 | A1* | 11/2007 | Wagner et al. | 524/590 |

FOREIGN PATENT DOCUMENTS

| | | | |
|---|---|---|---|
| WO | 2010050998 | A1 | 5/2010 |
| WO | 2010050999 | A1 | 5/2010 |

OTHER PUBLICATIONS

USPTO, International Search Report for International Application No. PCT/US2009/069359, dated Mar. 1, 2010.

The International Bureau of WIPO, International Preliminary Report on Patentability for International Application No. PCT/US2009/069359, dated Jul. 7, 2011.

IMPI, Mexican Office Action for Mexican Application No. MX/a/2011/006740, dated Apr. 9, 2014.

IMPI, Mexican Office Action for Mexican Application No. MX/a/2011/006740, dated Oct. 9, 2014.

EPO, Extended European Search Report for Application No. 09835817.9, dated Mar. 13, 2015.

* cited by examiner

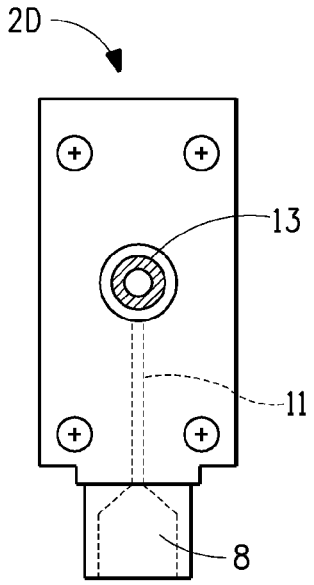
FIG. 3
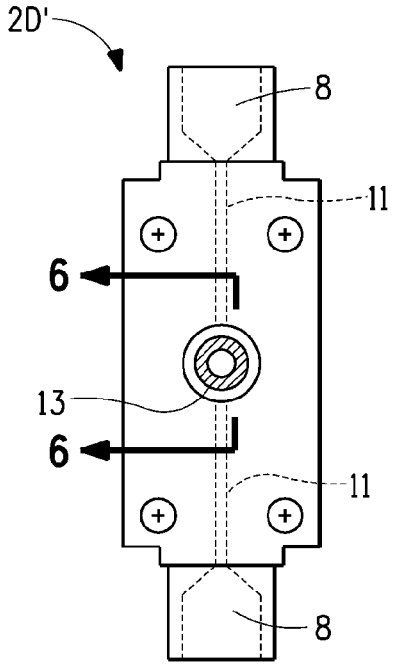
FIG. 4
FIG. 5
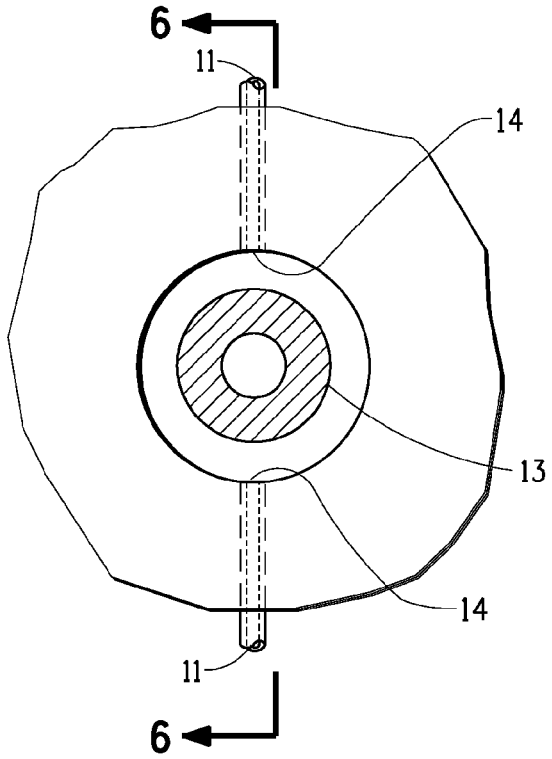

METHOD FOR CONTROLLING THE VISCOSITY OF A SPRAYABLE MIXTURE

FIELD OF INVENTION

The present invention is directed to a painting operation and method for controlling the viscosity of a coating composition wherein the coating composition is a sprayable mixture. This spray-applied mixture subsequently forms a layer of the coating composition which can be dried and cured to form a durable protective coating on a substrate.

BACKGROUND OF INVENTION

Automobile coatings typically comprise crosslinked polymer network formed by multiple reactive components. The coatings are typically sprayed onto a substrate such as automobile vehicle body or body parts using a spray device and then cured to form a coating layer having such crosslinked polymer network.

In spray technologies currently used, multiple reactive components of a coating composition are mixed to form a pot mix prior to spraying and placed in a cup-like reservoir or container that is attached to a spraying device such as a spray gun. Due to the reactive nature of the multiple reactive components, the pot mix will start to react as soon as they are mixed together causing continued increase in viscosity of the pot mix. Once the viscosity reaches a certain point, the pot mix becomes practically un-sprayable. The possibility that the spray gun itself may become clogged with crosslinked polymer materials is also disadvantageous. The time it takes for the viscosity to increase to such point where spraying becomes ineffective, generally up to a two-fold increase in viscosity, is referred to as "pot life".

One way to extend "pot life" is to add a greater amount of thinning solvent, also known as thinning agent, to the pot mix. However, thinning agent, such as organic solvent, contributes to increased emissions of volatile organic compounds (VOC) and also increases the curing time.

Other attempts to extend "pot life" of a pot mix of a coating composition have focused on "chemical-based" solutions. For example, it has been suggested to include modifications of one or more of the reactive components or certain additives that would retard polymerization reaction of the multiple components in the pot mix. The modifications or additives must be such that the rate of curing is not adversely affected after the coating is applied to the surface of a substrate.

Another approach is to mix one or more key components, such as a catalyst, together with other components of the coating composition immediately prior to spraying. One example is described in U.S. Pat. No. 7,201,289 in that a catalyst solution is stored in a separate dispenser and being dispensed and mixed with a liquid coating formulation before the coating formulation is atomized.

Yet another approach is to separately atomize two components, such as a catalyst and a resin, of a coating composition, and mix the two atomized components after spray. One such example is described in U.S. Pat. No. 4,824,017. However, such approach requires atomization of two components separately by using separate pumps and injection means for each of the two components.

STATEMENT OF THE INVENTION

In one embodiment, the current invention relates to a painting operation and a method for controlling the viscosity of a sprayable mixture. The method comprises the steps of:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice and wherein the viscosity of said first coating component remains substantially constant prior to being conveyed through said first inlet;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one delivery outlet coupled to a second storage container containing said second coating component, said delivery outlet being positioned at said orifice;

(C) optionally, regulating the supply of the second coating component to said delivery outlet by coupling a regulatory device to said delivery outlet;

(D) intermixing the first atomized stream and the second atomized stream to form a coating mixture; and applying the coating mixture on the substrate to form the layer of said coating composition thereon.

In another embodiment, the current invention relates to a painting operation and a method for controlling the viscosity of a sprayable mixture. The method comprises the steps of:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice and wherein the viscosity of said first coating component remains substantially constant prior to being conveyed through said first inlet;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one first delivery outlet of a delivery device coupled to a second storage container containing said second component, said first delivery outlet being positioned at said orifice;

(C) optionally, regulating the supply of the second coating component to said first delivery outlet by coupling a first regulatory device to said first delivery outlet;

(D) producing a subsequent atomized stream of a subsequent component of said coating composition, wherein the subsequent atomized stream is produced by siphoning the subsequent coating component with the siphoning stream from at least one subsequent delivery outlet coupled to a subsequent storage container containing said subsequent component, said subsequent delivery outlet being positioned at said orifice;

(E) optionally, regulating the supply of the subsequent coating component to said subsequent delivery outlet by coupling a subsequent regulatory device to said subsequent delivery outlet;

(F) intermixing the first atomized stream, the second atomized stream and the subsequent atomized stream to form a coating mixture; and (G) applying the coating mixture on the substrate to form the layer of said coating composition thereon.

BRIEF DESCRIPTION OF DRAWING

FIG. 3 shows an enlarged frontal view, in a schematic presentation, of a representative example of the delivery device 2D constructed as an add-on device that can be affixed to an air cap of a spray gun. A single intake coupling (8) is shown.

FIG. 4 shows an enlarged frontal view, in a schematic presentation, of another representative example of the delivery device 2D' constructed as an add-on device that can be affixed to an air cap of a spray gun. Two intake couplings (8) are shown.

FIG. 5 shows an enlarged frontal view of details of the delivery device and the relative position of the delivery device and the orifice of the spray gun. Two delivery outlets (14), two connection paths (11) and one orifice (13) are shown. The arrows 6 indicate the direction of a cross-sectional view used in FIGS. 6, 7 and 8.

DETAILED DESCRIPTION

Figure 1:
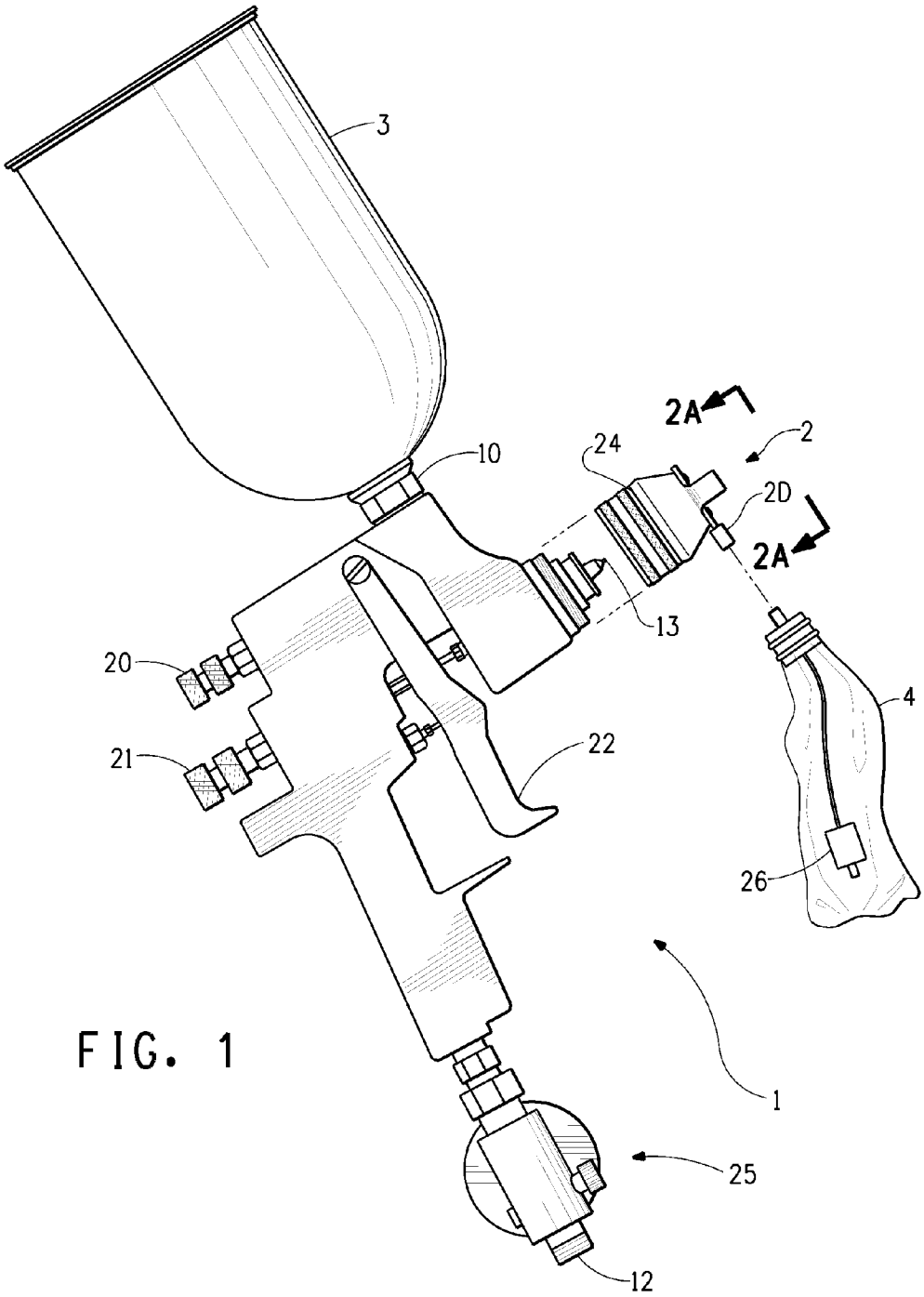
FIG. 1 shows a spray gun affixed with an example of a representative delivery device of this invention.

The features and advantages of the present invention will be more readily understood, by those of ordinary skill in the art, from reading the following detailed description. It is to be appreciated that certain features of the invention, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about". In this manner, slight variations above and below the stated ranges can be used to achieve substantially the same results as values within the ranges. Also, the disclosure of these ranges is intended as a continuous range including every value between the minimum and maximum values.

As used herein:

The phrase "coating composition" means a solventborne or waterborne liquid composition that can be applied to a substrate via a spray gun. The coating composition comprises a crosslinkable component and a crosslinking component. Other additives that are used to produce a coating composition are known in the art and, in general, are not discussed herein. Such additives can include organic solvents, aqueous solvents, pigments, rheology control agents, light stabilizers and leveling agents. In one embodiment, the coating composition comprises crosslinkable and crosslinking components that can be mixed together to form a pot mix prior to being spray applied using the method described herein. In another embodiment, the coating composition comprises crosslinkable and crosslinking components as separate components that can be applied as separate components using the method described herein.

The phrase "pot mix" means a mixture comprising a crosslinkable component and a crosslinking component that is formed prior to spray application. The pot mix can be added to the first storage container (3).

"Low VOC coating composition" means a coating composition that includes less than 0.6 kilograms per liter (5 pounds per gallon), preferably less than 0.52 kilograms per liter (4.3 pounds per gallon) of volatile organic component, and most preferably, less than 0.42 kilograms per liter (3.5 pounds per gallon), such as certain organic solvents. The phrase "volatile organic component" is herein referred to as VOC. VOC level is determined under the procedure provided in ASTM D3960.

The phrase "viscosity of a component remains substantially constant" means that the viscosity of the component shows, in one embodiment, an increase of less than 40% over an 8 hour period. In another embodiment, the increase in viscosity is less then 25% over a 12 hour period, and in a third embodiment, the viscosity increase is less than 10% over a 16 hour period. To measure the viscosity change over time, the viscosity of a component is measured at the time when the component is initially prepared; the component is stored in a covered container at room temperature for 8, 12 or 16 hours; the viscosity of the component is measured again using the same technique. The difference in the two viscosity measurements should not vary by more than percentages listed above. Several methods to measure the viscosity of a liquid are available. In one embodiment, the Zahn viscosity (in seconds) is measured.

"Productive paint" describes a coating composition wherein an applied layer of the coating composition, 10 to 150 micrometers thick, can be dried and cured, in one embodiment, in less than 20 minutes at 60° C. or in less than 90 minutes at room temperature. In another embodiment, the 10 to 150 micrometers thick layer of productive paint can be dried and cured in less than 10 minutes at 60° C. or in less than 45 minutes at room temperature. In a third embodiment, the 10 to 150 micrometers thick layer of productive paint can be dried and cured in less than 5 minutes at 60° C. or in less than 20 minutes at room temperature. Room temperature being defined as a temperature in the range of from 21° C. to 24° C.

By "dried and cured" is meant that the coating composition is crosslinked to the point that handling the substrate will not mar the surface, the substrate is dry to the touch and that dirt or dust won't stick to the surface. While some crosslinking has occurred, additional crosslinking can continue over time which will allow for the sanding and/or buffing of the applied layer, if necessary. Preferably, the sanding and/or buffing operations can occur within one hour of being dried and cured, and more preferably within one-half hour.

The phrase "consistent appearance" means that a measured appearance value of a layer of a dried and cured coating composition applied at a time when the painting operation begins, does not vary by a given percentage over the measured appearance value of a layer of the same dried and cured productive paint applied at a time that is 8 hours after the painting operation began. The measured appearance values can be the distinctness of image (DOI) or the long and short wavescan measurements of an applied coating. For the DOI measurement, the percentage change should be less than 10 percent and for the long and short wavescan measurements, the change should be less than 20 percent. As an example, a layer of a coating composition is applied to a first substrate using the method described herein. The applied layer of coating composition is dried and cured and the DOI, long and/or short wavescan measurements of the coating is obtained. After at least 8 hours, a similarly prepared second substrate is coated using the same method and with the same coating composition as was used to coat the first substrate. This second substrate is dried and cured using the same conditions as was used to dry and cure the first substrate. The measured appearance values should not vary by more than the percentages listed.

Distinctness of image and the long and short wavescan measurements can be measured using glossmeters or wavescan instruments available from Byk-Gardner USA, Columbia, Md.

The phrase "good appearance" means that a dried and cured multi-layer of a coating composition applied using the method described herein has a short wavescan measurement of less than 40. Preferably, the short wavescan is less than 30. Most preferably, the short wavescan is less than 20. The long wavescan can also be measured, and to be considered as having a good appearance, the long wavescan measurement should be less than 15. To determine the wavescan measurement, at least one of the applied primer, basecoat or clearcoat layers should be applied according to the present method. In one embodiment, at least the clearcoat composition is applied according to the disclosed method, and in a second embodiment, at least the primer and clearcoat compositions are applied according to the disclosed method. In a third embodiment a layer of primer, basecoat and clearcoat compositions are applied using the disclosed method.

"Crosslinkable component" includes a compound, oligomer or polymer having crosslinkable functional groups positioned in each molecule of the compound, oligomer, the backbone of the polymer, pendant from the backbone of the polymer, terminally positioned on the backbone of the polymer, or a combination thereof. Typical crosslinkable components can have on an average 2 to 25, preferably 2 to 15, more preferably 2 to 10, even more preferably 3 to 7, crosslinkable groups selected from hydroxyl, acetoacetoxy, thiol, carboxyl, primary amine, secondary amine, epoxy, anhydride, imino, ketimine, aldimine, silane, aspartate or a suitable combination thereof. One of ordinary skill in the art would recognize that certain crosslinkable group combinations would be excluded from the crosslinkable component of the present invention, since, if present, these combinations would crosslink among themselves (self-crosslink), thereby limiting their ability to crosslink with the crosslinking groups in the crosslinking components defined below.

"Crosslinking component" is a component that includes a compound, oligomer or polymer having crosslinking functional groups positioned in each molecule of the compound, oligomer, the backbone of the polymer, pendant from the backbone of the polymer, terminally positioned on the backbone of the polymer, or a combination thereof, wherein these functional groups are capable of reacting with the crosslinkable functional groups on the crosslinkable component (during the curing step) to produce a coating in the form of crosslinked structures. The crosslinking component can have on an average 2 to 25, preferably 2 to 15, more preferably 2 to 7, and even more preferably 3 to 5 crosslinking groups per molecule. Typical crosslinking components can be selected from a compound, oligomer or polymer having crosslinking functional groups selected from the group consisting of isocyanate, amine, ketimine, melamine, epoxy, carboxylic acid, anhydride, and a combination thereof.

A coating composition can further comprise a catalyst, an initiator, an activator or a combination thereof.

A catalyst can initiate or promote the reaction between reactants, such as between the crosslinkable functional groups of a crosslinkable component and crosslinking functional groups of a crosslinking component of a coating composition. The amount of the catalyst depends upon the reactivity of functional groups. Generally, in the range of from about 0.001 percent to about 5 percent, preferably in the range of from 0.01 percent to 2 percent, more preferably in the range of from 0.02 percent to 1 percent, all in weight percent based on the total weight of the crosslinkable component solids, of the catalyst is utilized. A wide variety of catalysts can be used, such as, for example, organotin compounds such as dibutyl tin dilaurate, tin (II) octanoate; 1,4-diazabicyclo[2.2.2]octane, zinc octoate, triphenyl phosphine, quaternary ammonium compounds, strong bases, aluminum halides, alkyl aluminum halides or tertiary amines, such as, triethylenediamine, depending upon the crosslinkable and crosslinking functional groups. These catalysts can be used alone or in conjunction with carboxylic acids, such as, acetic acid. One example of commercially available catalysts is dibutyl tin dilaurate as FASCAT® series sold by Arkema, Bristol, Pa., under respective trademark.

An activator can be a compound, oligomer or polymer containing crosslinkable functional groups that react very quickly with the functional groups of the crosslinking group or the activator can be polymers having a high concentration of crosslinkable groups, for example, non-aqueous dispersion or hyperbranched polymers. Such fast reacting compounds, oligomer or polymers can be added as one of the components described herein to help to build the crosslinked network of the applied layer of coating composition. Examples of crosslinkable functional groups that react quickly with a crosslinking component comprising isocyanate groups include, amines and/or aspartates.

An initiator can initiate one or more reactions. Examples can include photo initiators and/or sensitizers that cause photopolymerization or curing of a radiation curable coating composition, such as a UV curable coating composition upon radiation, such as UV irradiation. Many photo initiators are known to those skilled in the art and can be suitable for this invention. Examples of photo initiators can include, but not limited to, benzophenone, benzoin, benzoin methyl ether, benzoin-n-butyl ether, benzoin-iso-butyl ether, propiophenone, acetophenone, 1-hydroxycyclohexyl phenyl ketone, 2,2-diethoxyacetophenone, ethylphenylpyloxylate, diphenyl (2,4,6-trimethylbenzoyl)-phosphine oxide, phosphine oxide, phenyl bis(2,4,6-trimethyl benzoyl), phenanthraquinone, and a combination thereof. Other commercial photo initiator products, or combinations thereof, include, for example, DAROCURE® and IRGACURE® products available from Ciba Specialty Chemicals Corporation, New York.

In the coatings industry, many advances have been made that improve (reduce) the amount of volatile organic content of a coating composition. However, many of these low VOC coatings can be unacceptable due to their short pot life. One problem that a low VOC coating composition can exhibit is the rapid increase in the viscosity of a typical pot mix containing the crosslinkable and crosslinking components and the crosslinking catalyst. For example, it has been found that hyperbranched polymers have lower initial viscosities than does a linear polymer of the same concentration, molecular weight and monomer composition. This lower viscosity can reduce the need for a portion of the organic solvent resulting in a lower VOC composition. However, pot mixes containing hyperbranched polymers, crosslinking components and crosslinking catalysts build viscosity very quickly limiting their usefulness in coating compositions.

In conventional coating practice, the crosslinkable components and the crosslinking components are mixed with the crosslinking catalyst immediately prior to spraying. These catalyzed pot mixtures can have a pot life on the order of a few minutes to several (about 8) hours, after which the viscosity has increased to the point where the spray application of the composition can become difficult. The viscosity of the pot mix can also increase to the point that, while spray application is still feasible, the appearance of the resulting cured coating is degraded to the point of being unsatisfactory. The present disclosure provides a method for controlling the viscosity of a coating composition so that the pot life can be significantly increased over conventional coating practice and that the appearance of the dried and cured coating composition has a consistent appearance during the entire application period. A layer of dried and cured coating composition applied according to the disclosed method can also have a good appearance.

One embodiment of the disclosure is directed to a painting operation and a method for controlling the viscosity of a coating composition wherein said coating composition is a sprayable mixture. The coating composition can comprise two or more coating components. The method can comprise the following steps:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice, and wherein the viscosity of said first coating composition remains substantially constant prior to being conveyed through first inlet;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one delivery outlet of a delivery device coupled to a second storage container containing said second component, said delivery outlet being positioned at said orifice;

(C) optionally, regulating the supply of the second coating component to said delivery outlet by coupling a regulatory device to said delivery outlet;

(D) intermixing the first atomized stream and the second atomized stream to form a coating mixture; and (E) applying the coating mixture on the substrate to form the layer of said coating composition thereon.

Another embodiment of the method to control the viscosity of a coating composition wherein said coating composition is a sprayable mixture can comprise the steps of:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice, and wherein the viscosity of said first coating composition remains substantially constant prior to being conveyed through first inlet;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one first delivery outlet of a delivery device coupled to a second storage container containing said second component, said first delivery outlet being positioned at said orifice;

(C) optionally, regulating the supply of the second coating component to said delivery outlet by coupling a first regulatory device to said first delivery outlet;

(D) producing a subsequent atomized stream of a subsequent component of said coating composition, wherein the subsequent atomized stream is produced by siphoning the subsequent coating component with the siphoning stream from at least one subsequent delivery outlet of the delivery device coupled to a subsequent storage container containing said subsequent component, said subsequent delivery outlet being positioned at said orifice;

(E) optionally, regulating the supply of the subsequent coating component to said subsequent delivery outlet by coupling a subsequent regulatory device to said subsequent delivery outlet;

(F) intermixing the first atomized stream, the second atomized stream and the subsequent atomized stream to form a coating mixture; and (G) applying the coating mixture on the substrate to form the layer of said coating composition thereon.

Any spray gun that can produce a stream of atomized coating composition can be suitable for use with this method. A gravity feed spray gun is preferred. A gravity feed spray gun using a pressurized carrier as an atomization carrier is further preferred. The pressurized carrier can be selected from compressed air, compressed gas, compressed gas mixture, or a combination thereof. Typically, the pressurized carrier can be compressed air. Typically, a spray gun comprises a spray gun body (1), a nozzle assembly (2) including an orifice (13) and an air cap (24), a carrier coupling (12) for coupling to a source of a pressurized carrier, such as compressed air, an air regulator assembly (25) for regulating flow rate and pressure of the carrier, a coating flow regulator (21) for regulating the flow of the first coating component that is stored in a main reservoir also known as a first storage container (3), and a first inlet (10) coupling the spray gun (1) to the first storage container (3). The spray gun typically also includes additional controls such as a trigger (22) and a spray fan regulator (20) for regulating compressed air. In a typical gravity feed spray gun, the first coating component is typically not pressurized and stored in the first storage container (3) which is at atmosphere pressure. The first coating component can be conveyed to the orifice by gravity, siphoning, or a combination of gravity and siphoning.

The pressurized carrier can be selected from compressed air, compressed gas, compressed gas mixture, or a combination thereof. Typically, the pressurized carrier is compressed air. Compressed gas, such as compressed nitrogen, compressed carbon dioxide, compressed fluorocarbon, or a mixture thereof, can also be used. The compressed carrier can also include gases produced from compressed liquids, solids, or reactions from liquids or solids.

The coating composition can be a primer, a basecoat, a pigmented basecoat, or a clearcoat composition. The coating layer formed therefrom can be a primer layer, a basecoat layer, a pigmented basecoat layer, or a clearcoat layer, respectively.

In one embodiment of the present method, the first coating component can be a pot mix comprising a mixture of the crosslinkable and crosslinking components of a coating composition and the second coating component can include one or more materials selected from a catalyst, an initiator, an activator or a combination thereof.

In some embodiments, a mixture of the crosslinkable and crosslinking components that can be included in the first coating component and the catalyst/activator/initiator components that can be included as the second coating component are shown in Table 1.

TABLE 1

| First Coating Component | | Second Coating Component |
|---|---|---|
| Functional Groups of the Crosslinkable Component | Functional Groups of the Crosslinking Component | Catalyst, Activator, Initiator |
| Primary, secondary and/or tertiary hydroxyl groups | Isocyanates | Dialkyl tin diesters, zinc octoate, tin (II) octanoate, |
| Epoxide groups | Carboxylic acid and/or Anhydride groups | Tertiary Amine, Quaternary ammonium salts, phosphonium salts |
| Epoxide groups | Primary and/or secondary amine groups | Triphenyl phosphine, salicylic acid |
| Silane functional groups | Hydroxyl groups and/or isocyanates | Dialkyl tin diester, sulfonic acids |
| Thiol groups | Isocyanates | Amine catalyst |
| Hyperbranched Polymers containing hydroxyl and/or amine groups | Isocyanates | Dialkyl tin diester, |
| Ketimine and/or aldimine | Isocyanates | Salicylic acid |
| Primary, secondary and/or tertiary hydroxyl groups | Isocyanates | Aspartates and/or amines |
| Acetoacetate | Amines | Salicylic acid |
| Acetoacetate | Ketimine and/or aldimine | Salicylic acid |

Mixtures of crosslinkable functional groups of table 1 can also be used. For example, the crosslinkable component can be a polymer containing both hydroxy functional groups and thiol functional groups. In another example, the crosslinkable component can be a blend of polymers containing hydroxy functional groups and copolymers containing thiol functional groups. Suitable crosslinkable components are well-known in the art and are not discussed in-depth.

While it can be useful to combine the crosslinkable and the crosslinking components in the first coating component, some combinations of crosslinkable and crosslinking components can react too quickly, even in the absence of a catalyst, activator or initiator to use as the first coating component. Generally, crosslinkable components containing amine functional groups tend to react too quickly with some crosslinking components, especially crosslinking components containing isocyanate functional groups to used as the sole crosslinkable component. In one embodiment, amine containing crosslinkable components can be used up to about 50 percent by weight of the total weight of the crosslinkable component. In another embodiment, amine containing crosslinkable components can be used up to about 20 percent by weight of the total weight of the crosslinkable component. When using crosslinkable components containing amines and crosslinking components containing isocyanate groups, the amine containing crosslinkable components can be blended with other crosslinkable components, or they can be used as the second or subsequent coating component and applied according to the methods described herein.

In another embodiment, the crosslinkable component can be the first coating component, the crosslinking component can be the second coating component and optionally, a subsequent coating component can be added that can be a catalyst, activator and/or initiator. In another embodiment, the crosslinking component can be the first coating component, the crosslinkable component can be the second coating component and optionally, a subsequent coating component can be added that can be a catalyst, activator and/or initiator.

The choice of first coating components, second coating components and subsequent coating components is not particularly limited. One important consideration is to chose the individual components that make up each of the first, second and subsequent coating components so that the components do not react in such a way as to form crosslinked structures (which results in increasing viscosities) prior to being applied onto the substrate with the method disclosed herein. One of ordinary skill in the art would be able to chose those components in such a way so as to control the viscosity of the components prior to being applied such that when they are combined on the substrates, the components react to form a crosslinked network.

The crosslinking reactions used to form the crosslinked network can be addition reactions from the polymerization of unsaturated double bonds using any of the disclosed initiators, condensation reactions resulting from the condensation of, for example, a hydroxy group and an isocyanate group, or a combination of addition and condensation reactions can form the crosslinked network.

The current method refers to a painting operation and helps to control the viscosity of a coating composition wherein said coating composition is a sprayable mixture. Controlling the viscosity of the coating composition prior to applying to the substrate helps to maintain a consistent appearance of the subsequently cured coating composition over the entire application period.

In the past, a pot mix contained the crosslinkable and crosslinking components as well as any catalyst, activators and/or initiators to begin the crosslinking reactions. The crosslinking reactions began as soon as the pot mix was formed, and therefore the viscosity of the pot mix began to rise as soon as it was formed. The initial pot mix applied to a substrate had a relatively low viscosity when compared to the pot mix applied near then end of the life of the pot mix, generally when the viscosity increased by a factor of up to two. The lower viscosity of the first applied pot mix can have different flow characteristics than that of the later applied and more viscous pot mix. This change in flow properties can result in a gradual change in the appearance of the cured coating composition over the entire spray operation. The appearance change can be more pronounced when the application period occurs over a longer time period, such as when applying a coating composition over a large substrate.

The disclosed method for controlling the viscosity of a coating composition can result in a layer of a dried and cured coating composition having a consistent appearance. The disclosed method can use a productive paint and provide a layer of a dried and cured coating composition having a consistent appearance. The length of time that it takes to apply the coating composition according to the present method is not particularly critical, and can generally range from several minutes to 8 or more hours. While the method can be used in any painting operation, it can be suitable to use in the automobile refinish, the original equipment manufacturer (OEM) aviation, heavy duty truck and marine industries, and many other industries that apply coating to substrates.

The method, as described herein, can be applicable in many commercial painting industries. In the Fleet and auto auction markets, a quick curing coating is desired so as to maximize production output. Generally, quick curing compositions are produced by increasing the amount of catalyst added to the pot mix, which results in short pot life. With the current method, the pot mix viscosity remains substantially constant during the application, because the catalyst is not added until the atomization step. In the aviation, heavy duty truck and marine coating industries, the substrates can be very large. To coat such large areas, a long pot life composition is needed. Currently, pot mixes with low levels of catalysts are able to provide the necessary pot life. However, a low catalyst level results in a long cure time, which is undesirable. The method as described herein can provide the desired long pot life and also a relatively quick cure. In many other industrial coating operations, a very low VOC coating is desired due to the expensive solvent/air separation techniques necessary to comply with environmental regulations. These low VOC coatings typically have a short pot life. The current method can provide for low VOC compositions and extended pot life. In the primer/undercoat industry, large amounts of pigments and/or fillers are necessary to give the coatings the desired properties and the pigments and/or fillers can affect the catalyst activity over time due to the absorption of the catalyst onto the pigment/filler surface. This can result in inconsistent curing and pot life issues. Adding the catalyst at the atomization stage reduces the absorption of the catalyst onto the pigment/filler surface which can help to eliminate the curing and pot life issues. It is also known that catalysts and other ingredients that are typically added to clearcoat compositions can lead to the discoloration of the uncured compositions prior to application. The discoloration is often seen as a yellowing of the clearcoat compositions on storage. The present method can be used to add the catalysts and other ingredients during the spraying operation so that there is no color development prior to the application of the composition.

In the above embodiments, the one or more components of the second coating component can be siphoned separately such as in the configurations shown in FIG. 9A, 10C, 10E or 10H. The one or more sub-components of the second coating component can be siphoned together such as in the configurations shown in FIG. 10B.

The second coating component can be siphoned from at least one delivery outlet (14) with a siphoning stream selected from the first atomized stream of the first coating component, the stream of the pressurized carrier, or a combination thereof. The delivery outlet is coupled to a second storage container containing said second component, said delivery outlet being positioned at said orifice. Said delivery outlet and said orifice can be positioned at any relative angles or relative positions such that the siphoning can effectively take place. While not wishing to be bound by any particular theory, "siphoning" is believed to occur when the siphoning stream is moving at high speed at the delivery outlet causing negative air pressure around the delivery outlet. Such negative air pressure is believed to cause the second coating component to be conveyed to the delivery outlet. High velocity of the stream of the pressurized carrier and sudden change in air pressure associated with the negative air pressure at the delivery outlet are believed to cause the second coating component to become atomized and intermixed into the siphoning stream and the first atomized stream of the first coating component. In this invention, the first and the second coating components can be mixed at a pre-determined mixing ratio to form the coating mixture. The second coating component can also be conveyed to the delivery outlet by gravity or a combination of gravity and siphoning in certain embodiments of configurations disclosed herein.

Both the first and the second coating component can be stored in respective storage containers at atmosphere pressure.

Figure 6:
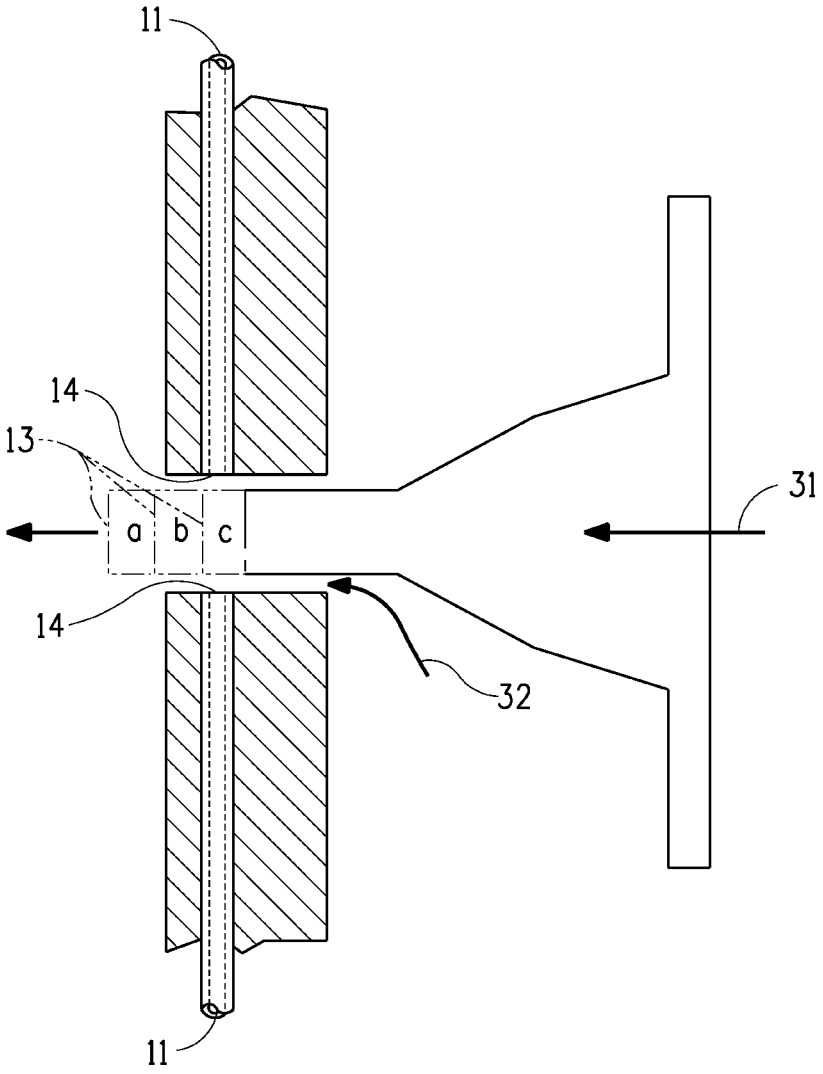
FIG. 6 shows an enlarged side cross sectional view of details of one example of the delivery device and the relative position of the delivery device and the orifice of the spray gun. The orifice (13) can be positioned in three different regions indicated with a, b and c, respectively.
Figure 7A:
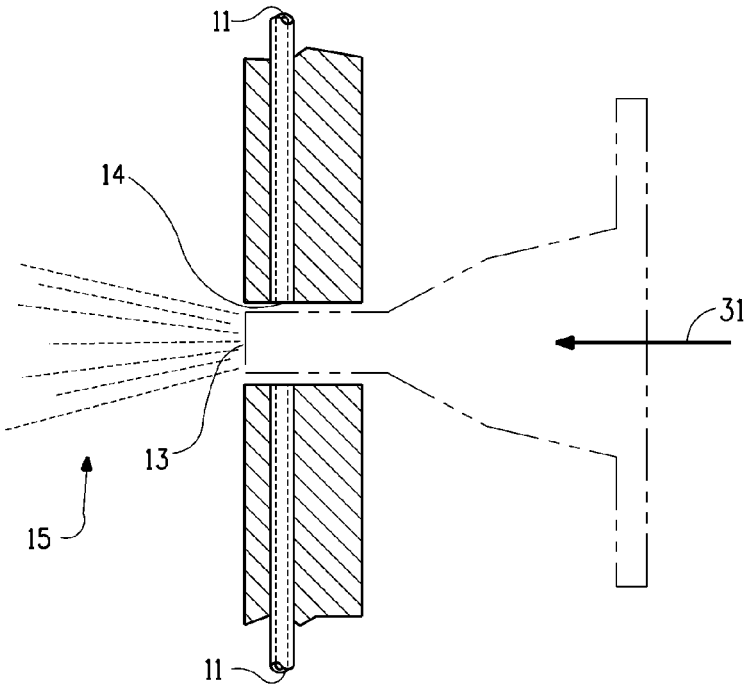
FIG. 7 shows schematic presentations of examples of the formation of a coating mixture. (A) An example of a first coating component that is atomized at an orifice of a spray gun without the introduction of a second coating component. (B) An example of the coating mixture formed by an atomized first coating component and an atomized second coating component.
Figure 7B:
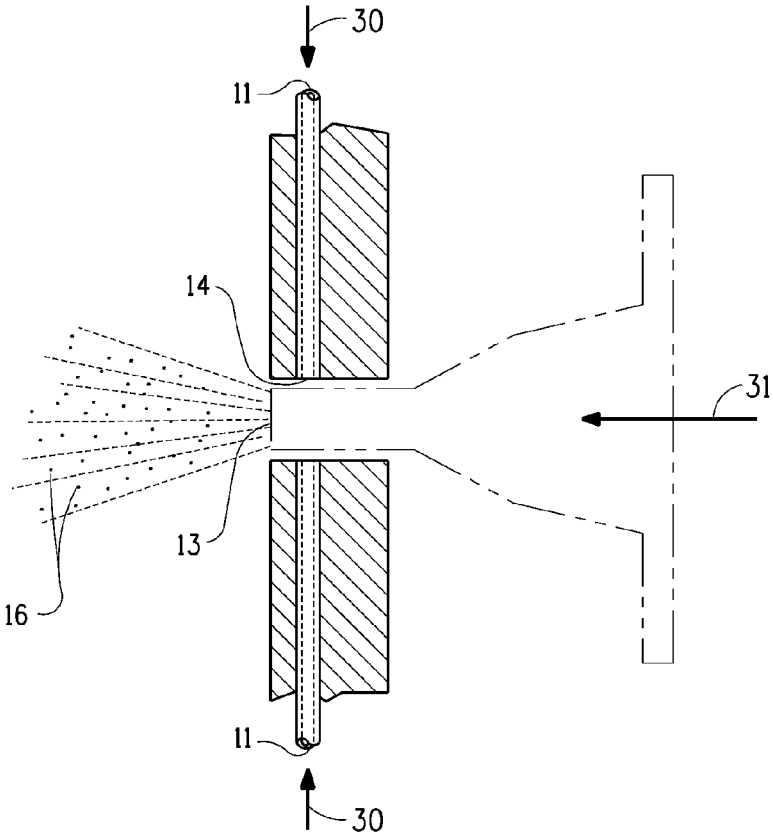
Figure 8A:
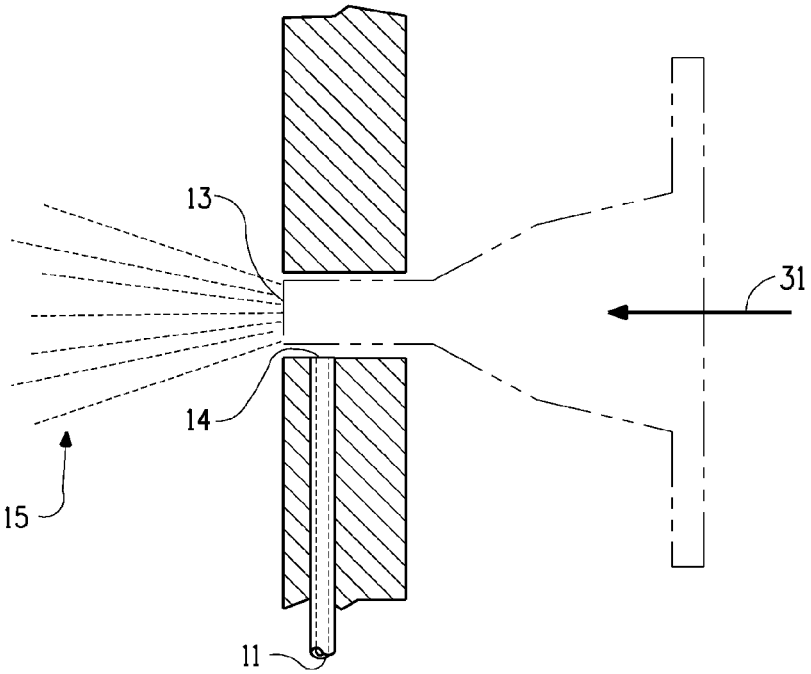
FIG. 8 shows schematic presentations of another example of the formation of a coating mixture. (A) A first coating component atomized at an orifice of a spray gun without the introduction of a second coating component. (B) A coating mixture formed by an atomized first coating component and an atomized second coating component.
Figure 8B:
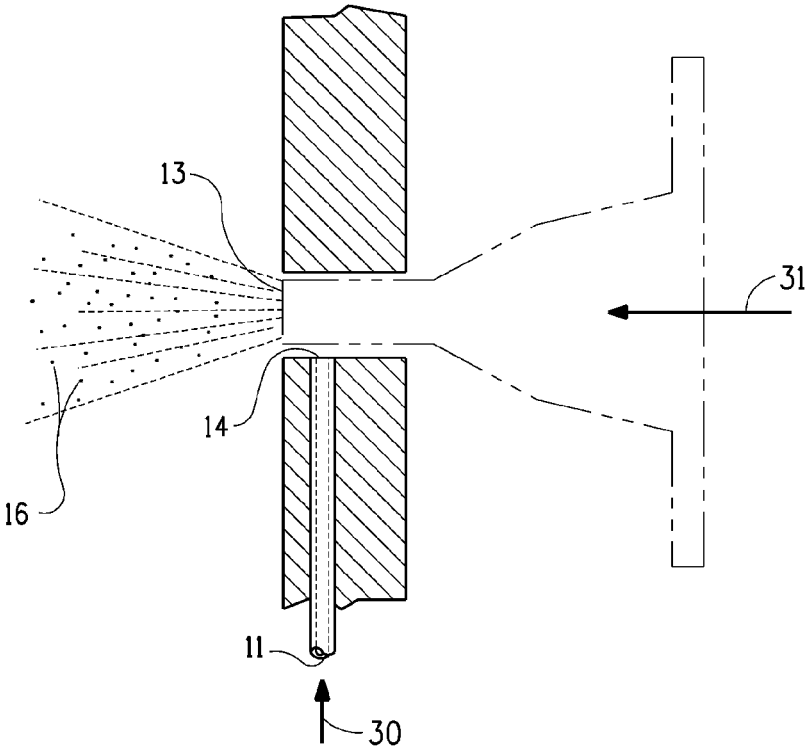

Depending upon the relative position between the orifice (13) and the delivery outlet (14), the second coating component can be siphoned with different siphoning stream. When the orifice is positioned in the position illustrated by the region 13*a* and 13*b* in FIG. 6, the second coating component can be siphoned primarily by the pressurized carrier moving at high speed in the direction shown by the arrow (32). FIG. 7 shows examples of a delivery device having two delivery outlets. FIG. 8 shows examples of a delivery device having one delivery outlet. The pressurized carrier then continues to produce atomized first coating component at the orifice (13). The atomized first and second coating component can be intermixed to form the coating mixture (16) (FIGS. 7B and 8B). When the orifice is positioned in the position illustrated by the region 13*c* in FIG. 6, the second coating component can be siphoned primarily by a combination of the pressurized carrier moving at high speed in the direction shown by the arrow (32) and the first atomized stream of the first coating component. If the second coating component is not supplied to the delivery outlet, for example, if a regulatory device (32) is turned off, then only the first coating component is atomized (15) (FIGS. 7A and 8A). Flow of the first coating component is indicated by the arrow (31). Flow of the second coating component is indicated by the arrows (30).

The coating mixture can be applied over a substrate. Typically, a painter can hold the spray gun at a certain distance from the substrate and move it in desired directions so the coating mixture can be sprayed over the substrate forming a layer of the coating composition. This invention can further comprise the step of curing the layer of the coating composition on the substrate to form a coating thereon. This curing step can depend upon the coating composition used. The layer can be cured at ambient temperatures or elevated temperatures, up to 180° C. The curing can also be done by exposing the coating layer to radiation, such as UV light or electron beam, when the coating composition is radiation curable.

The substrate can include wood, plastic, leather, paper, woven and nonwoven fabrics, metal, plaster, cementitious and asphaltic substrates, and substrates that have one or more existing layers of coating thereon. The substrate can be a vehicle, vehicle body, or vehicle body parts.

In another embodiment, the method to control the viscosity of a coating composition can comprise the steps of:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice, and wherein the viscosity of said first coating composition remains substantially constant prior to being conveyed through first inlet;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one first delivery outlet of a delivery device coupled to a second storage container containing said second component, said first delivery outlet being positioned at said orifice;

(C) optionally, regulating the supply of the second coating component to said delivery outlet by coupling a first regulatory device to said first delivery outlet;

(D) producing a subsequent atomized stream of a subsequent component of said coating composition, wherein the subsequent atomized stream is produced by siphoning the subsequent coating component with the siphoning stream from at least one subsequent delivery outlet of the delivery device coupled to a subsequent storage container containing said subsequent component, said subsequent delivery outlet being positioned at said orifice;

(E) optionally, regulating the supply of the subsequent coating component to said subsequent delivery outlet by coupling a subsequent regulatory device to said subsequent delivery outlet;

(F) intermixing the first atomized stream, the second atomized stream and the subsequent atomized stream to form a coating mixture; and (G) applying the coating mixture on the substrate to form the layer of said coating composition thereon.

The first delivery outlet and the subsequent delivery outlet can be separate delivery outlets or combined into a single delivery outlet. FIGS. 2C, 2D, 4, 5, 6, 7, 9A show some examples of separate delivery outlets. FIG. 9B show one example where two delivery outlets can be combined into a single delivery outlet. Based on disclosure of this invention herein, more delivery outlets and/or different placement and positioning of delivery outlets can be configured by those skilled in the art without departing from the scope and spirit of this invention.

All the components, including the first and the second coating component, and any subsequent component can be stored in respective storage containers at atmosphere pressure.

One advantage of this invention is that said atomized first coating component, said atomized second coating component, and any subsequent coating component if present, can be mixed at a pre-determined mixing ratio to form said coating mixture without the need for complex controls such as those described in aforementioned U.S. Pat. No. 4,824,017. The pre-determined mixing ratio can be determined by modulating or selecting the size of the delivery outlet (14), the size of connecting path (11), or by providing a regulatory device such as a flow rate controller functionally coupled to said delivery device, or a combination thereof. It can be configured that one regulatory device can regulate the flow rate of one or more delivery outlets. Mixing ratio can also be controlled by modulating the viscosity of the first, the second or both the first and the second coating components. In one example, viscosity of the second coating component can be increased to reduce the amount being siphoned into the coating mixture. In another example, viscosity of the second coating component can be reduced to increase the amount being siphoned into the coating mixture. Similarly, viscosity of the first coating component can be reduced or increased as needed to achieve a desired mixing ratio.

The applicants unexpectedly discovered that using the method of this invention, mixing ratio can be constant within a wide range of pressures of the pressurized carrier ranging from 20-80 pounds per square inch gauge (psig). In one example, pressure of the pressurized carrier can be in a range of from 25 to 70 psig. In another example, pressure of the pressurized carrier can be in a range of from 28 to 65 psig. In yet another example, pressure of the pressurized carrier can be in a range of from 30 to 60 psig.

In one example, the mixing ratio can be determined by selecting different sizes of the diameter of the delivery outlet. Coating mixtures formed by using different sizes of the outlets can be sprayed onto suitable substrates. Properties of the coating layers formed thereon can be measured. Based on the property measurement, a suitable size or a range of suitable sizes of the delivery outlets can be selected. In another example, the mixing ratio can be determined by selecting different size of diameter of the connection path.

The regulatory device can be selected from a mechanical flow restrictor, an electric flow restrictor, a pressure controlled flow restrictor, an actuated pneumatic flow restrictor, or a combination thereof. Examples of a mechanical flow restrictor can include a tube with a pre-determined flow pass diameter that is coupled to the delivery outlet, or a mechanical valve that can control flow passage. Examples of an electronic flow restrictor can include electrical valves or a electrical valve actuator. A pressure controlled flow restrictor can be any mechanical or electric controllers that can control flow based on pressure.

A flow rate controller, such as a valve or a commercial inline flow controller can be coupled to the delivery outlet to adjust the flow of the second coating component therefore affecting mixing ratio. A flow rate controller can also be a small insert that is placed inside a connection path or a tubing connected to a connection path that is coupled to the delivery outlet. Such an insert can effectively reduce the size of the connection path or the tubing therefore reduces the flow of the second coating component.

Selection of sizes and the use of flow rate controller can be combined. For example, a size within a suitable range of the delivery outlet can be selected and a valve can be coupled to the delivery outlet so the mixing ratio can be fine tuned. Any flow rate controller that can be coupled to the delivery outlet can be suitable for this invention.

A regulatory device can be coupled to a delivery outlet at any places that can effectively regulate flow to that delivery outlet. The regulatory device can be coupled at an intake coupling or be placed in a connection path connecting to that particular delivery outlet. The regulatory device can also be placed at any place along a tubing that delivers the second or the subsequent coating component from its storage container to the intake coupling of the delivery device.

Another advantage of this invention is to have fast curing while maintaining extended pot life. In conventional process, short pot life is a challenge when a coating composition is formulated to be fast curing since all components are mixed together in a pot mix and curing reaction starts immediately upon mixing. In this invention, the coasting composition can have extended pot life before spraying since one or more component for cuing, such as a catalyst, is not mixed together. The coating composition can then be cured rapidly after spraying since the second coating component, such as a catalyst, is mixed after atomization during spraying.

Yet another advantage of this invention is that some aspects of spraying or the coating property can be modified in an on-demand fashion. For example, curing time of a coating composition can be modulated by modifying the amount of a catalyst mixed into the coating composition during spraying. It can be done by tuning the regulatory device while spraying.

This disclosure is further directed to a system for controlling the viscosity of a coating composition. The system can comprise:

(A) a spray gun comprising a spray gun body (1), one or more inlets, a nozzle assembly (2) including an orifice (13) and an air cap (24); and (B) a delivery device comprising:

(i) at least one delivery outlet (14), wherein said delivery outlet being positioned at said orifice (13);

(ii) at least one intake coupling (8); and (iii) at least one connection path (11) connecting said intake coupling (8) and said delivery outlet (14), wherein said delivery outlet is coupled through said connection path and said intake coupling to a storage container (4) containing a second coating component;

(C) optionally, a regulatory device (32) coupled to said delivery outlet regulating the supply of the second coating component to said delivery outlet;

wherein a first atomized stream of a first coating component of said coating composition is produced at said orifice (13) with a stream of a pressurized carrier, wherein said first coating component is stored in a first storage container and conveyed through a first inlet of said spray gun to said orifice, and wherein the viscosity of the first coating component remains substantially constant prior to being conveyed through said first inlet;

wherein a second atomized stream of a second coating component of said coating composition is produced by siphoning the second coating component with a siphoning stream selected from the first atomized stream of the first coating component, the stream of the pressurized carrier, or a combination thereof, from said delivery outlet (14) coupled to a second storage container containing said second component.

The delivery outlet (14), the intake coupling (8), and the connection path (11) can be constructed as an add-on device affixed to the air cap of the spray gun, or can be constructed into the air cap of said spray gun. Representative examples of the add-on device can include the ones shown in FIGS. 2A, 3, 4, 9A and 9B. The add-on device can be affixed to the air cap using conventional means such as one or more screws, clips, clamps, adhesives, latches, or a combination thereof. Examples of the delivery device constructed into the air cap can include those shown in FIGS. 2B, 2C and 2D. The delivery device can comprise one delivery outlet, such as those shown in FIGS. 2A, 2B and 3. The delivery device can also comprise two or more delivery outlets, such as those shown in FIGS. 2C, 2D, 4, and 9A. Two or more delivery outlets can be combined into a single delivery outlet, such as the one shown in FIG. 9B.

Figure 2A:
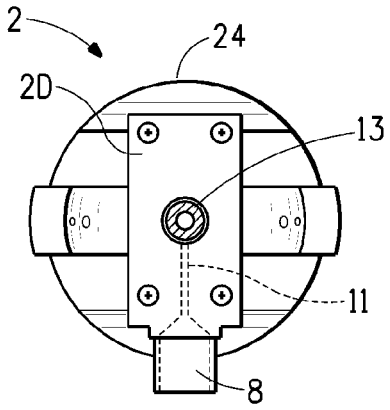
FIG. 2 shows frontal views of the delivery device viewed from the direction 2A indicated in FIG. 1. (A) A schematic presentation of a representative example of the delivery device 2D constructed as an add-on device. (B) A schematic presentation of a representative example of the delivery device 2' having one delivery outlet constructed into the air cap of the spray gun. (C) A schematic presentation of a representative example of the delivery device 2" having two delivery outlets constructed into the air cap of the spray gun. (D) A schematic presentation of a representative example of the delivery device 2'" having three delivery outlets (14) constructed into the air cap of the spray gun.
Figure 2B:
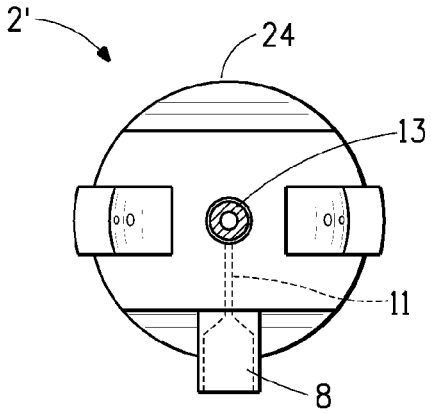
Figure 2C:
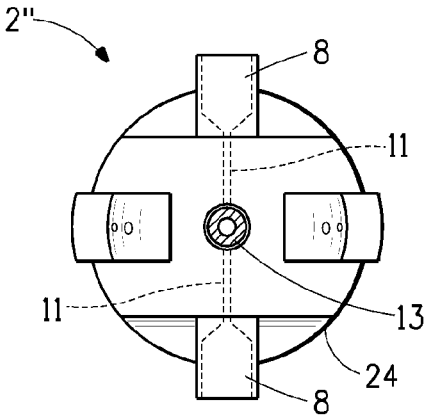
Figure 2D:
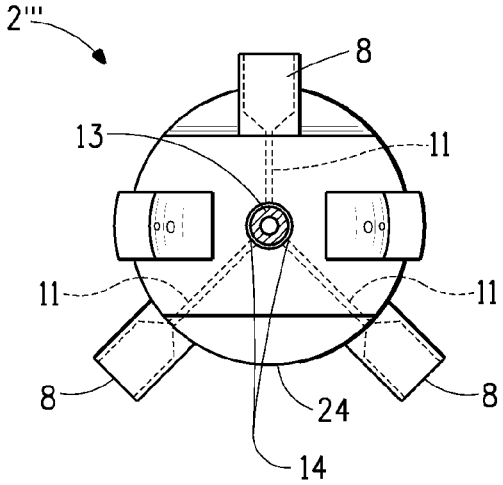
Figure 9A:
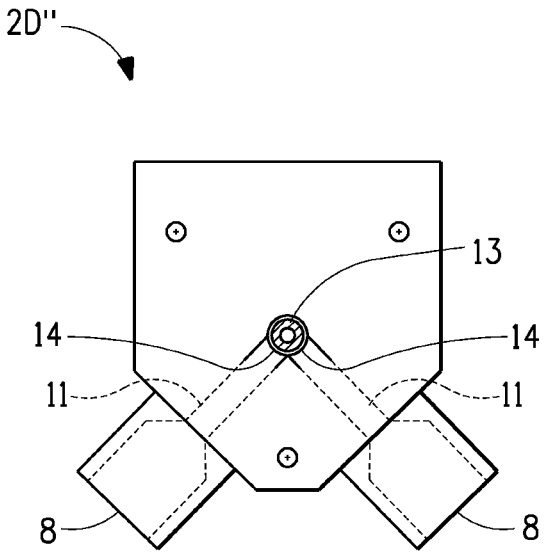
FIG. 9 shows additional examples of the delivery device of this invention constructed as an add-on device. (A) An example of the delivery device that has a configuration of two intake couplings (8) and two delivery outlets (14). (B) An example of the delivery device that has a configuration of two intake couplings (8) and one common delivery outlet (14). The orifice (13) is shown in the figure to indicate relative position of the delivery device when affixed to the air cap. The orifice (13) is part of the spray gun.
Figure 9B:
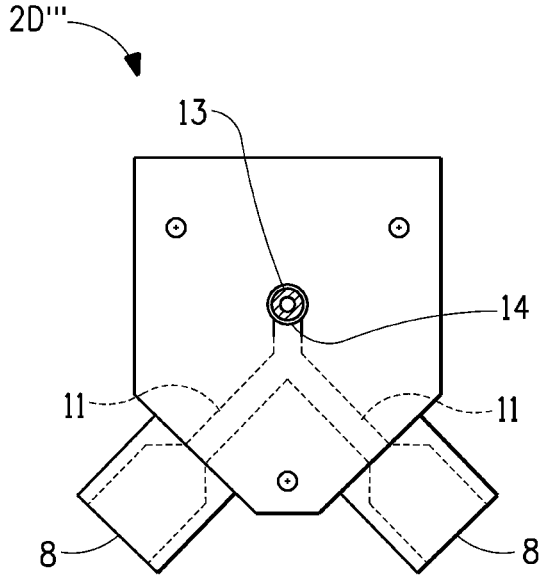
Figure 10A:
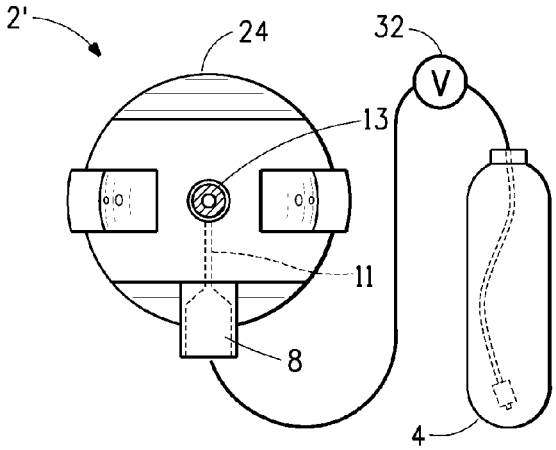
FIG. 10 shows schematic presentations of different configurations of the delivery device of this invention. (A) An example of a delivery device having one intake coupling that is coupled to one storage container. (B) An example of a delivery device having one intake coupling that is coupled to two individual storage containers. (C) An example of a delivery device having two intake couplings that are coupled to two storage containers. (D) An example of a delivery device having three intake couplings that all three of them are coupled to a single storage container. (E) An example of a delivery device having three intake couplings that one of them is coupled to an individual storage container while other two are coupled to a single container. (F) Another example of a delivery device having three intake couplings that only one of them is coupled to a single storage container. (G) Another example of a delivery device having three intake couplings that two of them are coupled to a single storage container. (H) Another example of a delivery device having three intake couplings that each of the first and the second is coupled to an individual storage container while the third is not coupled to any container. The schematic representations are for illustration purposes only and items in the presentations may not be to scale. The orifice (13) is part of the spray gun.
Figure 10B:
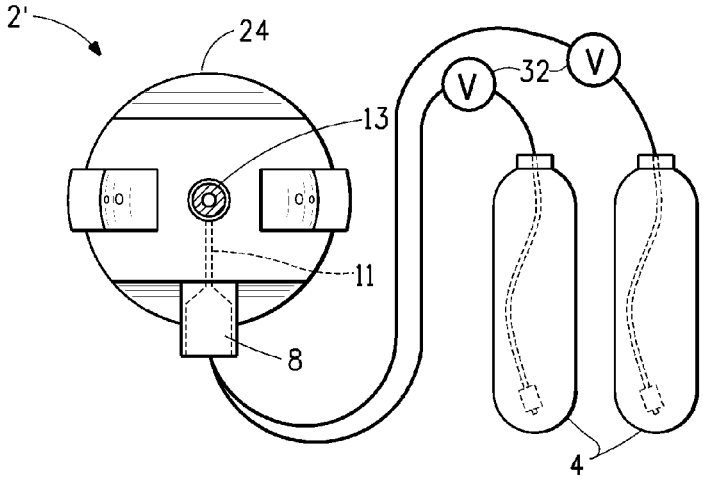
Figure 10C:
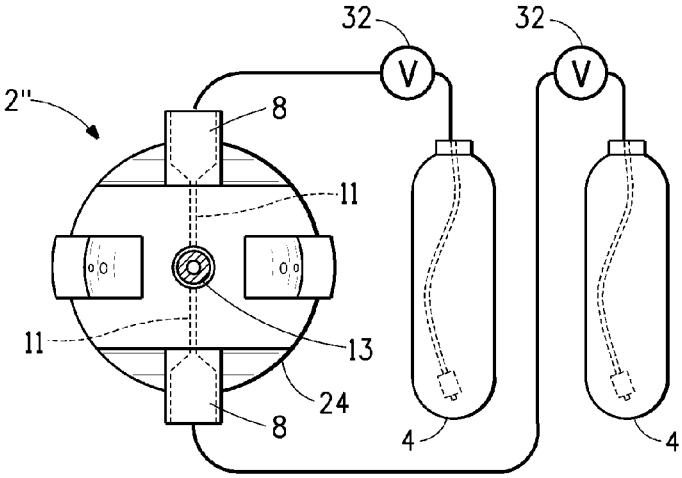
Figure 10D:
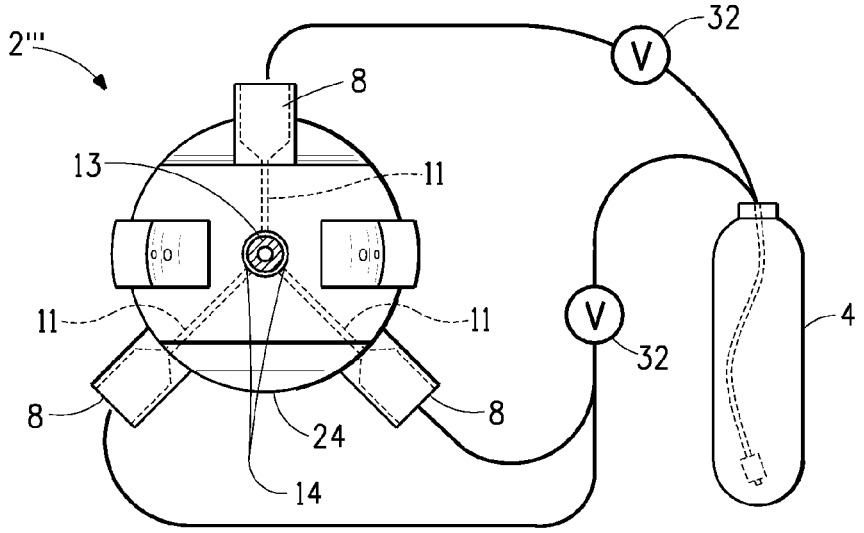
Figure 10E:
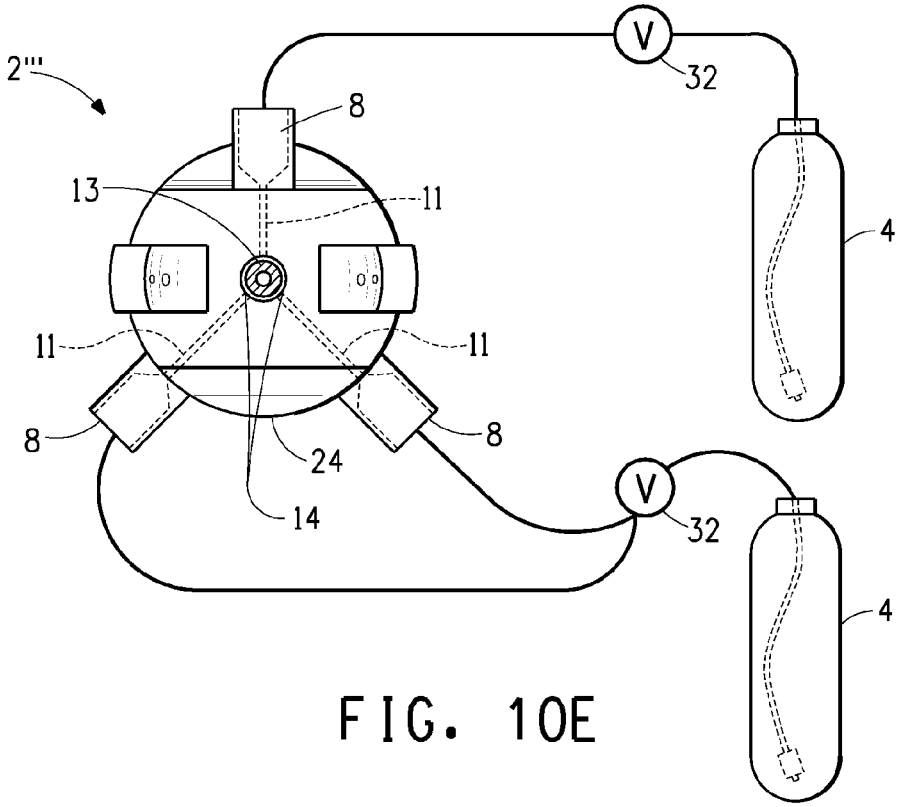
Figure 10F:
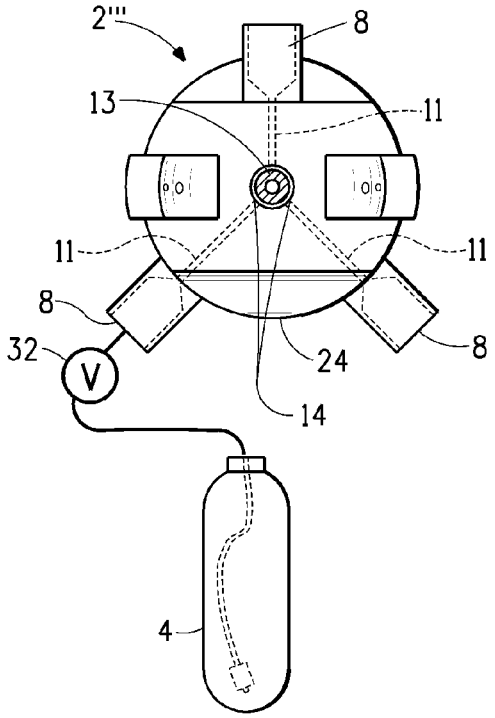
Figure 10G:
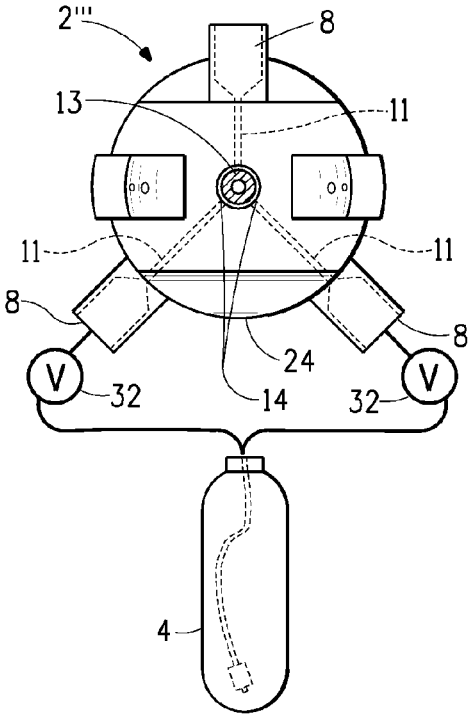
Figure 10H:
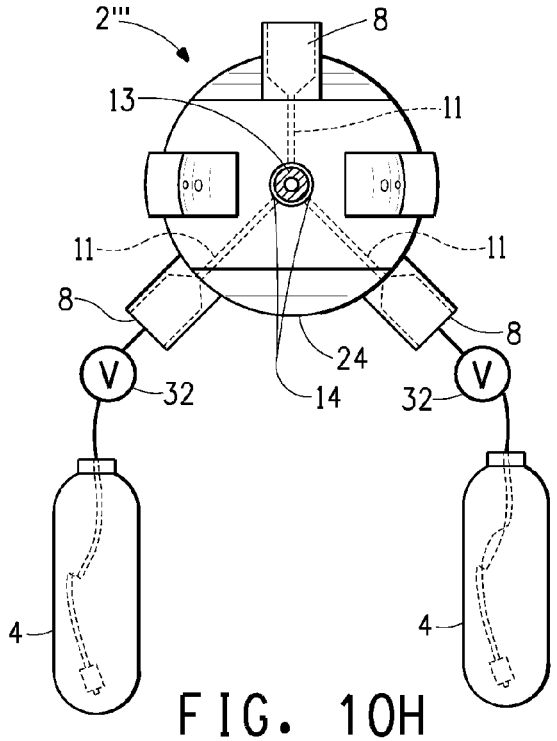

Representative configurations of the add-on device (2D) can be shown in FIGS. 2A, 3, 4, 9A, and 9B. The system can have a single delivery outlet (14), such as shown in FIGS. 2A, 3, and 9B; or two or more delivery outlets (14) as shown in FIGS. 4 and 9A. Based on descriptions disclosed herein, those skilled in the art can make modifications and re-configurations so the add-on device can be used with other spray guns, nozzle assemblies, air caps, or a combination thereof.

FIG. 5 shows an enlarged frontal view of the orifice (13) and two of the delivery outlets (14). FIG. 6 shows a cross sectional side view of the delivery device indicating the relative positions of two of the delivery outlets (14) and the orifice (13) wherein each of the delivery outlets (14) is positioned at said orifice (13). As described before, depending upon the relative position between the orifice (13) and the delivery outlet (14), the second (or a subsequent) coating component can be siphoned with different siphoning stream. Although perpendicular relative position is shown in the Figures and examples of this disclosure, the delivery outlet and the orifice can be positioned in any relative positions such that siphoning can effectively take place.

The system described herein can be configured to siphon a third or a subsequent component. A delivery device of this invention can be configured to have multiple intake couplings (8), multiple connection paths (11) or multiple delivery outlets (14) as shown in representative examples in FIGS. 2C, 2D, 4, 9A, and 9B. Other examples of configurations are shown in FIGS. 10A through 10H. In another representative configuration, two or more connection paths can be combined at a point so the connection paths are connected to a single delivery outlet (14), which can be positioned at the orifice (13). One example is shown in FIG. 9B.

The one or more intake couplings (8) can be configured to couple with one or more individual storage containers (4) through direct coupling, such as plug on or screwed on, or via connection means such as fixed or flexible tubing. Additional hardware such as one or more "Y" shaped connectors can also be used. Examples of suitable configurations are shown in FIG. 10: (A) a delivery device having a single delivery outlet/intake coupling that is coupled to a single container; (B) a delivery device having a single intake coupling that is coupled to two individual containers; (C) a delivery device having two outlets/intake couplings that are coupled to two individual containers (shown) or a single container (not shown); (D)-(H) a delivery device having multiple outlets and intake couplings that only some of them are coupled to one or more containers, wherein the other intake(s) can be closed. When a delivery device has two or more intake couplings and only one of them is coupled to a container, it is preferred to close the uncoupled intake couplings via conventional means, such as a cap, a plug, or a valve. Optionally, one or more regulatory devices (32) that controls flow rate, such as a valve, an insert, a clamp, or a commercial inline flow controller can be positioned and configured to control flow rate of one or more components at one or more positions. The regulatory device can be selected from a mechanical flow restrictor, an electric flow restrictor, a pressure controlled flow restrictor, or a combination thereof. Those skilled in the art can design or modify configurations based on the descriptions disclosed herein without departing from the spirit and scope of this invention.

Figure 11:
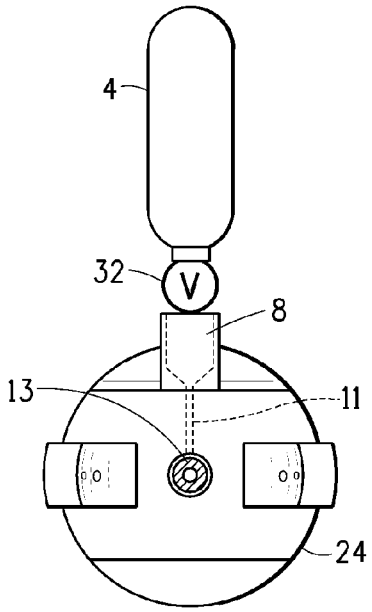
FIG. 11 shows an example of another representative configuration.

FIG. 11 shows an example of another representative configuration. In this example, the container (4) can be connected at the top of the intake coupling (8) via conventional connections, such as a screw connection or a plug-in connection. A regulatory device (32), such as a valve, can be placed in the path connecting the container (4) and the intake coupling (8). In one example, the regulatory device (32) is a valve has two coupling ends: one coupled to the intake coupling (8) and the other coupled to the container (4). In another example, the regulatory device (32) is a valve built in the container that can be coupled to the intake coupling (8). In yet another example, the regulatory device (32) is a valve built in the intake coupling (8) that can be coupled to the container (4). The regulatory device (32) can be turned on or off manually, or by connecting to the trigger (22) mechanically or electronically. It is preferred that the regulatory device (32) can be turned off when the spray gun is not spraying to prevent leaking of the contents in the container (4) and can be turned on to allow the content in the container (4) to flow to the delivery outlet (14).

The storage container (4) containing the second or a subsequent coating component can be a flexible container, such as a plastic bag; a fixed-shape container, such as a canister made of metal or hard plastic; or a flexible inner container inside a fixed-shape container, such as a flexible plastic bag placed inside a fixed-shape metal container. A flexible container that can be collapsed easily is preferred. The flexible container can be a collapsible liner that can be sealed and used directly or be placed inside a fixed shape container. The storage container can be transparent or have a transparent window so the level of the content in the container can be readily visible. The storage container can have an indicator to indicate the level of the contents in the container. The storage container can be disposable or reusable. The storage container can be coupled to an intake coupling (8) which is connected to the delivery outlet (14) through a connection path (11). The storage container can be coupled to the intake coupling (8) via conventional means, such as a clip, a clamp, a set of matching screw tracks, or a plug-in. In one example, the storage container comprises a tube that can be plugged into the intake coupling (8). In another example, the storage container is screwed onto the intake coupling (8) via matching screw tracks. In yet another example, the storage container is plugged into the intake coupling (8) and secured by an additional fastener. The storage container can further have a unidirectional flow limiter (26) to eliminate back flow, wherein said unidirectional flow limiter can only allow the content to flow in one direction, such as only from the container to the delivery outlet. Any back flow can be stopped by the directional flow limiter to avoid potential contamination. For a fixed-shape container, ventilation can be provided so the contents in the container can be maintained at atmosphere pressure.

EXAMPLES

The present invention is further defined in the following Examples. It should be understood that these Examples, while indicating preferred embodiments of the invention, are given by way of illustration only. From the above discussion and these Examples, one skilled in the art can ascertain the essential characteristics of this invention, and without departing from the spirit and scope thereof, can make various changes and modifications of the invention to adapt it to various uses and conditions.

Viscosity can be determined by using Zahn cup #2 viscosity measurements in second. Pot life in following examples is defined by the length of time required to double viscosity of the coating composition or the relevant pot mix.

Micro-hardness of the coatings was measured using a Fischerscope hardness tester (model HM100V). The tester was set for maximum force of 100 mN ramped in series of 50, 1 second steps. The hardness was recorded in N/mm.

Wavescan was measured using a Wavewscan instrument from Byk-Gardner. Both short (s) and long (L) values were recorded.

Cotton free test: after baking the coating, the panel was tested by dropping a cotton ball from a distance of 1 inch. The cotton ball was left on the coating for 2 minutes and then the panel was inverted. If the cotton ball falls off the panel, without leaving any residue, it is said to be cotton free.

Coating Examples 1-3

DuPont ChromaClear® G2-7779S™, under respective registered or unregistered trademarks, was mixed with an activator 7775S (both available from E. I. duPont de Nemours and Company, Wilmington, USA) according to manufacturer's directions to form a first coating mix, also referred to as a first coating component. The first coating component was placed in the main storage container (also referred to as a first storage container) of a gravity spray gun.

Various catalyst solutions were prepared according to Table 1. Each was used as a second coating component and was placed in a second container of the spray gun.

Mixing ratio of the first coating component/the second coating component was controlled at about 13/1 by selecting a suitable size of a connection tubing connecting the second container and the delivery outlet of the delivery device.

The clearcoats prepared above were sprayed over Uniprime (ED-5000, cold-rolled steel (04X12X032)B952 P60 DIW unpolish Ecoat POWERCRON 590 from ACT Laboratories, Hillsdale, Mich.) to a film thickness of 2.3 to 2.6 mils. The coatings were baked for 5 min or 10 min at 60° C. as indicated.

TABLE 3

Coating Properties.

| | Example 1 0.125% DBTDL in ethyl acetate | Example 2 0.125% DBTDL and 2% acetic acid in ethyl acetate | Example 3 0.0625% DBTDL, and 0.5% acetic acid in ethyl acetate |
|---|---|---|---|
| Cotton free after 5 min at 60° C. | No | No | Yes |
| Cotton free after 10 min. at 60° C. | Yes | Yes | Yes |
| Wavescan L 1 day after baking for 5 min | 3.8 | 2.0 | 1.7 |
| Wavescan s 1 day after baking 5 min | 12.0 | 7.9 | 4.3 |
| Fischer Micro-hardness 4 hrs after 5 min bake (N/mm) | 5.0 | 5.0 | 4.0 |
| Fischer Micro-hardness 4 hours after 10 min bake (N/mm) | 5.0 | 4.0 | 4.0 |

DBTDL = dibutyltin dilaurate.

Examples 4-6

DuPont ChromaClear® G2-7779S™ is placed in a first storage container of a gravity spray gun as a first coating component. The activator 7775S is placed in a second storage container of the spray gun as a second coating component. Mixing ratio between the first and the second coating component is set at about 12/3.

In Example 4, 0.125% of DBTDL as in Example 1 is used as a third coating component and placed in a third storage container. Mixing ratio of the first/the second/the third coating components is set as 12/3/1.

In Example 5, 0.125% of DBTDL and 2% acetic acid as in Example 2 is used as a third coating component and placed in a third storage container. Mixing ratio of the first/the second/the third coating components is set as 12/3/1.

In Example 6, 0.0625% of DBTDL and 0.5% acetic acid as in Example 3 is used as a third coating component and placed in a third storage container. Mixing ratio of the first/the second/the third coating components is set as 12/3/1.

Coatings are sprayed over substrates as described in Examples 1-3.

Example 7

DuPont ChromaClear® G2-7779S™ is mixed with an activator 7775S as in Example 1-3 and is placed in the first storage container of a gravity spray gun as a first coating component.

DBTDL at the concentration of 0.25% is used as a second coating component and placed in a second storage container. Four percent acetic acid in ethyl acetate is used as a third coating component and placed in a third storage container.

A mixing ratio of the first/the second coating component=13/0.5 is used. During spray, a valve controlling the flow of the third coating component (4% acetic acid) is initially turned on so acetic acid is mixed into the coating mixture. The valve is then slowly turned off during spray so decreasing amount of acetic acid is mixed into the coating mixture. Coating is sprayed over substrates as described in Examples 1-3. Acetic acid is believed to modulate the activity of the catalyst DBTDL. With less acetic acid, the activity of DBTDL is higher so the coating can be cured faster. With decreasing amount of acetic acid during spray, the entire coating layer can cure evenly.

What is claimed is:

1. In a painting operation, a method for controlling the viscosity of a coating composition wherein said coating composition is a sprayable mixture, said method comprising the steps of:

(A) producing a first atomized stream of a first coating component of said coating composition through an orifice of said spray gun with a stream of a pressurized carrier, wherein said first coating component is stored in a first storage container and conveyed through a first inlet of said spray gun to said orifice and wherein the viscosity of said first coating component remains substantially constant prior to being conveyed through said first inlet, wherein the first coating component is a mixture comprising a crosslinking component and a crosslinkable compound, oligomer or polymer having on average 2 to 25 crosslinkable functional groups selected from the group consisting of hydroxyl, acetoacetoxy, thiol, carboxyl, primary amine, secondary amine, epoxy, anhydride, imino, ketimine, aldimine, silane, aspartate and a combination thereof, wherein the crosslinkable compound, oligomer, or polymer comprises the aspartate crosslinkable functional group;

(B) producing a second atomized stream of a second coating component of said coating composition, wherein the second atomized stream is produced by siphoning the second coating component with a siphoning stream selected from the first atomized stream of the first coating component, the stream of the pressurized carrier, or a combination thereof, from at least one delivery outlet coupled to a second storage container containing said second coating component, said delivery outlet being positioned at said orifice;

(C) optionally, regulating the supply of the second coating component to said delivery outlet by coupling a regulatory device to said delivery outlet;

(D) intermixing the first atomized stream and the second atomized stream to form a coating mixture; and (E) applying the coating mixture on the substrate to form the layer of said coating composition thereon.

2. The method of claim 1, wherein the first coating component further comprises the crosslinking component selected from a compound, oligomer or polymer having crosslinking functional groups and wherein the crosslinking functional groups are selected from the group consisting of isocyanate, amine, ketimine, melamine, epoxy, carboxylic acid, anhydride, and a combination thereof.

3. The method of claim 1, wherein the applied coating mixture can be dried and cured in less than 20 minutes at 60° C. or in less than 90 minutes at room temperature.

4. The method of claim 3 wherein a layer of the coating composition applied over an 8 hour period provides a dried and cured layer of a coating composition having a consistent appearance.

5. The method of claim 3 wherein the dried and cured layer of coating composition has a short wavescan measurements of less than 40.

6. The method of claim 1, wherein a layer of the coating composition applied over an 8 hour period provides a dried and cured layer of a coating composition having a consistent appearance.

7. The method of claim 1, wherein said layer is a primer layer, a basecoat layer, a pigmented basecoat layer, or a clearcoat layer.

8. The method of claim 1, wherein the second coating component comprises one or more materials selected from a catalyst, an initiator, an activator or a combination thereof.

9. The method of claim 8 wherein the second coating component comprises a hyperbranched polymer.

10. The method of claim 1, wherein said second coating component comprises a catalyst selected from the group consisting of tin catalysts, tertiary amines and a combination thereof.

11. The method of claim 1, wherein said second atomized stream is produced by siphoning the second coating component with the first atomized stream.

12. The method of claim 1, wherein said second atomized stream is produced by siphoning the second coating component with the stream of the pressurized carrier.

13. The method of claim 1, wherein said second atomized stream is produced by siphoning the second coating component with a combination of the first atomized stream and the stream of the pressurized carrier.

14. The method of claim 1, wherein said substrate is a vehicle, vehicle body, or vehicle body parts.

15. The method of claim 1, wherein said regulatory device is selected from a mechanical flow restrictor, an electric flow restrictor, a pressure controlled flow restrictor, or a combination thereof.

16. The method of claim 1 further comprising the step of curing said layer of said coating composition on the substrate to form a coating thereon.

* * * * *